US005738439A

United States Patent [19]

Flower

[11] Patent Number: 5,738,439

[45] Date of Patent: Apr. 14, 1998

[54] MIXING APPARATUS

[76] Inventor: Arnold B. Flower, 164 Wilson Drive, Milton, Ontario, Canada, L9T 3J9

[21] Appl. No.: 752,105

[22] Filed: Nov. 20, 1996

[51] Int. Cl.[6] ..... B01F 7/04

[52] U.S. Cl. ..... 366/325.92; 366/327.1; 366/327.4

[58] Field of Search ..... 366/292, 297, 366/299, 325.92, 327.1, 327.4, 330.1, 325.4, 325.1

[56] References Cited

U.S. PATENT DOCUMENTS

| | | | |
|---|---|---|---|
| Re. 3,012 | 6/1868 | Raynor | 366/327.4 |
| 1,081,516 | 12/1913 | Reinhol . | |
| 1,498,286 | 6/1924 | Marsh . | |
| 1,722,571 | 7/1929 | Green . | |
| 2,010,579 | 8/1935 | Broadfield | 366/330.1 |
| 2,017,116 | 10/1935 | Bonnell | 366/327.4 |
| 2,283,008 | 5/1942 | LeBar et al. . | |
| 2,630,302 | 3/1953 | Jones . | |
| 2,750,163 | 6/1956 | Loedige et al. | 366/327.4 |
| 2,917,395 | 12/1959 | Csanyi . | |
| 3,071,352 | 1/1963 | McIntyre | 366/327.4 |
| 3,645,813 | 2/1972 | Pelikan et al. . | |
| 4,238,159 | 12/1980 | Tielens et al. | 366/327.4 |
| 4,619,381 | 10/1986 | Wurtz | 222/272 |
| 4,650,343 | 3/1987 | Doom et al. | 366/327.4 |
| 4,791,735 | 12/1988 | Forberg | 34/181 |
| 5,025,287 | 6/1991 | Hilbert | 355/245 |
| 5,098,669 | 3/1992 | Kawanami et al. | 366/327.4 |
| 5,161,888 | 11/1992 | Hauck | 366/299 |
| 5,299,865 | 4/1994 | Presnell | 366/300 |
| 5,340,214 | 8/1994 | Juzwiak | 366/292 |
| 5,419,635 | 5/1995 | Schulte et al. | 366/85 |
| 5,435,494 | 7/1995 | Knitght et al. | 366/297 |

FOREIGN PATENT DOCUMENTS 1284635 6/1994 Canada .

*Primary Examiner*—Tony G. Soohoo
*Attorney, Agent, or Firm*—Rogers & Scott

[57] ABSTRACT

A mixer for mixing particulates is provided having a housing including parallel side walls and end walls arranged orthogonally with respect to the side walls, and a cylindrical curved bottom wall blending tangentially into the side walls and meeting the end walls, the bottom wall being curved about a longitudinal axis passing through the end walls. A mixing element has a shaft mounted for rotation about the axis and extends between the end walls. The element also includes a plurality of outer paddles, and a plurality of inner paddles to define a series of mixing zones spaced axially along the shaft. Each of the mixing zones includes at least one of the outer paddles angled relative to the axis to drive particulates in a first axial direction and at least one of the inner paddles angled relative to the axis to drive particulates in the opposite axial direction. As a result at least some of the particulates in a zone move firstly in the axial direction under the influence of the outer paddle and then in the opposite axial direction under the influence of the inner paddle, and the zones combine to effect mixing of the particulates.

The mixer can be used in a modular fashion by grouping several mixers essentially in side-by-side relationship in a common housing to increase the volume of the mixer.

4 Claims, 3 Drawing Sheets

MIXING APPARATUS

FIELD OF THE INVENTION

This invention relates to particulate mixers of the type having a housing for receiving particulates, and mixing elements in the housing for rotation to engage and to mix the particulates by agitating them within the housing.

BACKGROUND OF THE INVENTION

It is desirable when mixing particulates that the mixer meet a number of more important criteria including the time needed for proper mixing, the power used by the mixer to conduct the mixing, and of course the quality of the mixing.

There have been a number of mixers designed in an attempt to meet these design criteria. Such mixers generally have included two shafts which rotate mixing elements in opposite directions in a housing. The arrangements are such that the particulates are driven axially along side walls of the housing towards an end wall, and then the particulates move towards the centre before being driven in the opposite axial direction between the shafts where mixing primarily takes place. A variety of forms of mixing elements have been used in such arrangements and these include spiral types such as that shown in U.S. Pat. No. 5,299,865, and paddle types such as that shown in U.S. Pat. No. 4,278,355.

It would clearly be desirable to minimize the capital cost of mixers and also to improve the efficiency of the mixer in use. The cost could be reduced by minimizing the equipment needed to conduct the mixing and efficiency would be improved if the material were moved into a mixing relationship continuously rather than moved about the equipment into a zone where mixing takes place.

Accordingly it is an object of the present invention to provide an improved mixer requiring less capital investment and providing more efficient mixing.

SUMMARY OF THE INVENTION

A mixer for mixing particulates is provided having a housing including parallel side walls and end walls arranged orthogonally with respect to the side walls, and a cylindrical curved bottom wall blending tangentially into the side walls and meeting the end walls, the bottom wall being curved about a longitudinal axis passing through the end walls. A mixing element has a shaft mounted for rotation about the axis and extends between the end walls. The element also includes a plurality of outer paddles, and a plurality of inner paddles to define a series of mixing zones spaced axially along the shaft. Each of the mixing zones includes at least one of the outer paddles angled relative to the axis to drive particulates in a first axial direction and at least one of the inner paddles angled relative to the axis to drive particulates in the opposite axial direction. As a result at least some of the particulates in a zone move firstly in the axial direction under the influence of the outer paddle and then in the opposite axial direction under the influence of the inner paddle, and the zones combine to effect mixing of the particulates.

The mixer can be used in a modular fashion by grouping several mixers essentially in side-by-side relationship in a common housing to increase the volume of the mixer.

Figure 1:
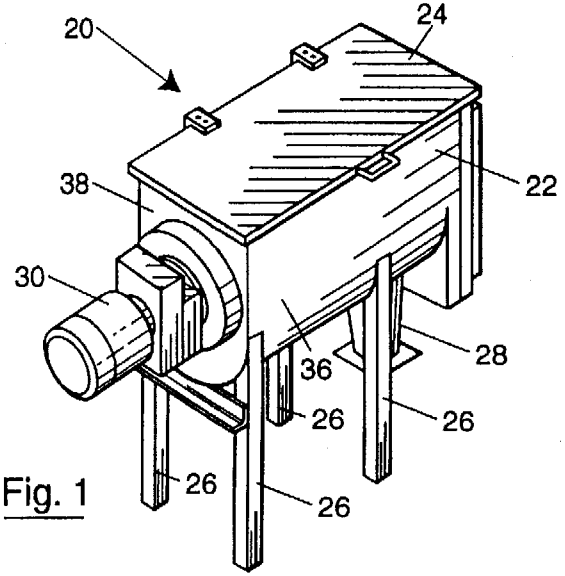
FIG. 1 is a somewhat diagrammatic perspective view of a single shaft mixer according to a preferred embodiment of the invention.

Reference is made firstly to FIG. 1 which illustrates the general appearance of a mixer 20 according to the invention. It will be seen that the mixer includes a housing 22 having a lid 24 and the housing stands on supports 26. Material is fed into the mixer via the lid 24 and after mixing the material leaves via an exit 28. A drive unit 30 is attached to the housing to drive a mixing element (not shown in FIG. 1) within the housing 22 to move particulates within the housing thereby mixing the particulates as will be explained.

Figure 2:
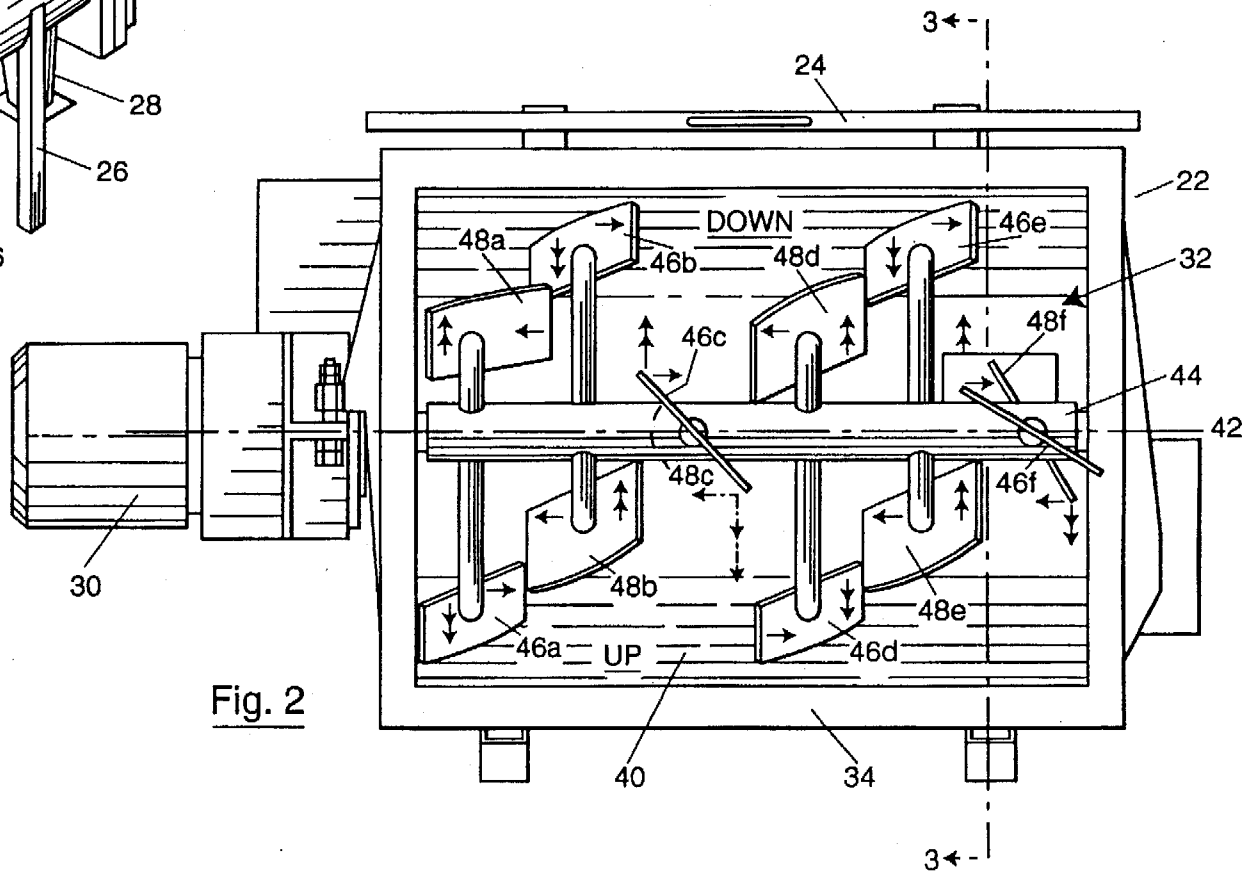
FIG. 2 is a plan view of the mixer drawn to a larger scale and with the lid open to show inner parts.

More details of the structure can be seen in FIG. 2. The lid 24 is open in FIG. 2 so that this top view shows a mixing element designated generally by the numeral 32 contained within the housing 22. It will be seen from FIGS. 1 and 2 that the housing 22 includes a flanged top 34 defining a rectangular top opening which can be covered by closing the lid 24. A pair of parallel side walls 36 (one of which can be seen in FIG. 1) extend longitudinally and downwardly and end walls 38 (one of which can be seen in FIG. 1) extend transversely to complete the rectangular shape. The side walls blend tangentially into a cylindrically curved bottom wall 40 which meets the end walls 38 and defines a semi-circular inner surface at the bottom of the housing 22. The cross-sectional shape of the housing and location of the mixing element 32 can be seen in FIG. 3.

The cylindrically curved bottom wall 40 is generated about a longitudinal axis 42 mid-way between the side walls and this axis which is also the axis of rotation of a heavy shaft 44 forming part of the mixing element 32. The shaft is coupled to the drive unit 30 so that operation of this unit will rotate the shaft in an anti-clockwise direction as seen from the left of FIG. 2. For convenience the two sides shown in FIG. 2 are labelled respectively UP and DOWN.

The mixing element 32 has a series of paddles dependent from the shaft 44. These paddles are of two general types, namely outer paddles 46*a* to 46*f*, and inner paddles 48*a* to 48*f*. The relative positions of the paddles can be seen from FIG. 2 and FIG. 3 and it will be evident that in the embodiment shown, there is an angular separation between the alternating outer paddles and inner paddles of about 60 degrees and between similar paddles of about 120 degrees.

It will be seen that each of the outer paddles 46*a* to 46*f* is positioned to travel closely to the bottom wall 40 in order to sweep particulates off this wall. These outer paddles are spaced longitudinally of the shaft 44 and angled with reference to the axis 42 by about 45 degrees. Consequently, as these paddles move angularly in the particulates, there is a sliding action to cause the particulates to move axially and to create a controlled void behind the paddle where particulates can move relative to one another. This movement is key to the operation of the invention and will be described in more detail with reference particularly to FIG. 2. In order to facilitate the description of this action, each of the paddles shown in FIG. 2 has two different arrows drawn on it. In all cases a double arrow indicates a horizontal component of the paddle movement as the shaft rotates, and a single arrow indicates the direction in which the particulate material is forced to move relative to the horizontal. The arrows indicating paddle movement will reverse direction as the paddle passes through a horizontal plane containing the axis of the shaft 44. For example, paddle 46 is moving upwardly but it is below horizontal and the horizontal component of movement is outwardly (i.e. towards the bottom of FIG. 2 as drawn). By contrast the same component for adjacent paddle 48*b* is in the opposite direction because this paddle is above the axis.

Figure 3:
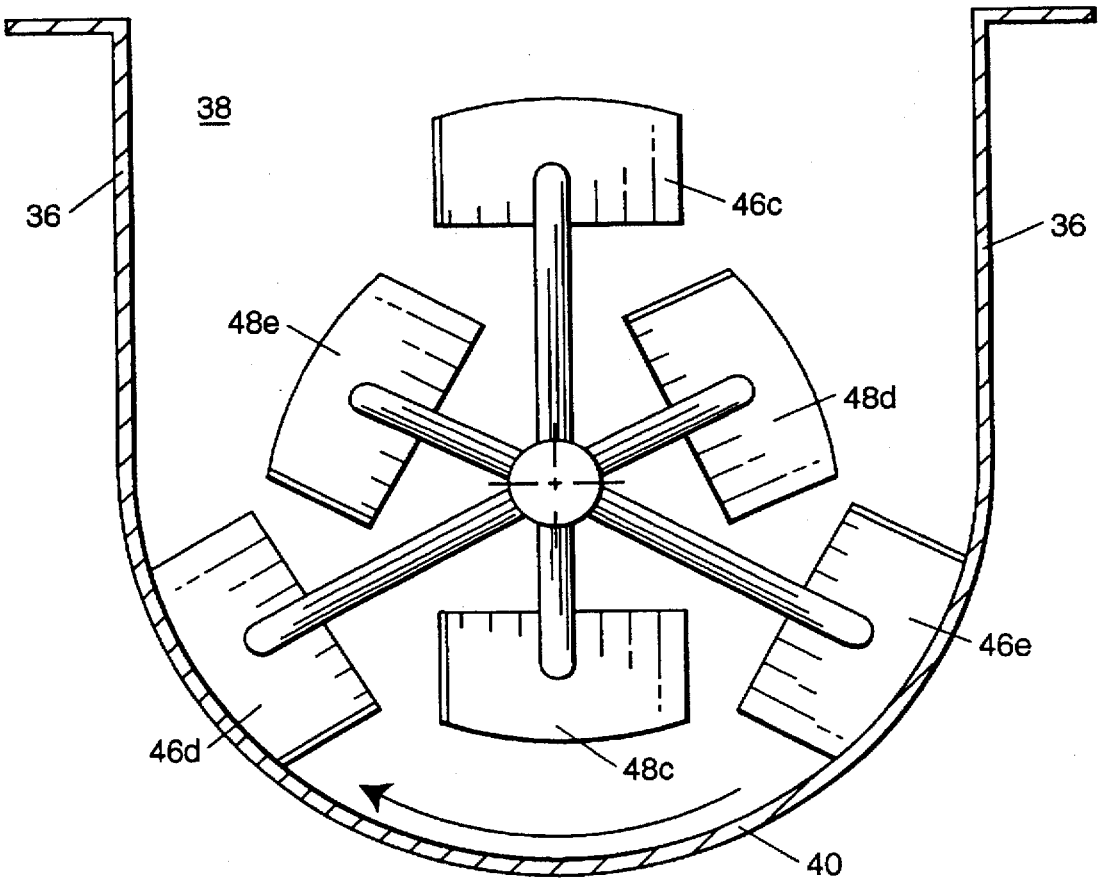
FIG. 3 is a diagrammatic sectional view taken generally on line 3—3 of FIG. 2.

Consider the paddle 46*a* with reference to FIGS. 2 and 3. As the paddle moves upwardly, it will cause particulates to move axially away from the drive unit 30. Contrast this with the inner paddle 48*b*. This paddle is above the centre line of the shaft 44 and consequently as it moves upwardly, it also moves towards the centre line 42 thereby displacing particulate material axially towards the drive unit 30. It is important to note that although the paddles 46*a* and 48*b* appear somewhat similar in FIG. 2 they are in fact reversed. The appearance in FIG. 2 is because the paddle 46*a* is below the centre line and the paddle 48*b* is above the centre line. As a result they act to displace particulates in opposite directions horizontally. This reversal is evident in comparing paddles 46*c* and 48*c*. Both paddles are positioned at 45 degrees to the axis 42 with the outer paddle 46*c* projecting upwardly from the shaft 44. When this paddle rotates with the shaft through 180 degrees, it would take a new position in FIG. 2 at 90 degrees to the position shown in FIG. 2. It will therefore be evident that because paddle 48*c* lies in the same plane as paddle 46*c* in FIG. 2, the paddles must be reversed relative to one another.

As the shaft 44 rotates, there will be some particulates driven towards the end wall 38 remote from the drive unit 30 and the pressure on this wall is relieved by the paddle 46*f* which is angled at about 30 degrees to the axis 42 to promote primarily radial motion to the particulates and allow them to escape from pressure against the end wall. Similarly, the inner paddles 48*b* will tend to move some particulates towards the end wall 38 at the drive unit 30 and the inner paddle 48*a* is angled at about 30 degrees to the axis 42 to provide similar relief.

The outer paddles 46*a* to 46*f* are separated one from another both axially and angularly and between each pair of paddles there is an inner paddle 48*a* operating to move particulates in the opposite direction. For convenience, each of the paddles 48*a* to 48*f* lies on a common shaft with one of the corresponding paddles 46*a* to 46*f*. However, the main point about the relationship is seen in FIG. 3 where each of the outer paddles is separated functionally by an inner paddle and vice versa. Consequently, as seen in FIG. 2, when the paddle 46*a* causes movement to the right as drawn, at least some of the particulates then come under the influence of the inner paddle 48*b* which is driving particulates in the opposite axial direction. There is a zone set up where particulates are influenced first in one direction and then in another and of course some particulates escape from that zone to the next zone defined by a pair of paddles. The result is that mixing takes place in zones.

Conversely, the arrangement of the paddles generally is such that simple axial movement from one paddle to the next is broken up to ensure that particulates come under the influence of paddles driving the particulates first in one direction and then in another.

The result of the arrangement is that particulate mixing is done efficiently on a single shaft mixer. It has been found that a fifty percent volume of particulates measured as a percentage of the volume swept by the mixing element, results in efficient mixing of more frangible materials. Materials that have less likelihood of damage can be loaded in the hopper to a height of 75 percent of the volume of the mixing element to achieve efficient mixing.

The actual sizing of the housing and paddles will dictate the speed of rotation of the mixing element. If the paddles were too fast there will be an unacceptable cavitation behind the paddles, whereas if the speed is too slow there will be little opportunity for mixing. It will also be apparent that because the inner paddles operate about a smaller radius, these paddles have less peripheral velocity than the outer paddles. Consequently, the inner paddles can be larger to increase separation behind these slower moving paddles.

The angular spacing and axial separation between paddles can be varied consistent with causing the particulates to be affected in zones containing at least one outer and one inner paddle. Clearly, if the paddles are separated angularly the particulates will tend to be entrained in an axial movement perpetuated by frequent urging in an axial direction by similar paddles. This should be avoided in order to ensure that the influence of adjacent similar paddles is separated by the influence of a different paddle thereby creating zonal mixing.

Figure 4:
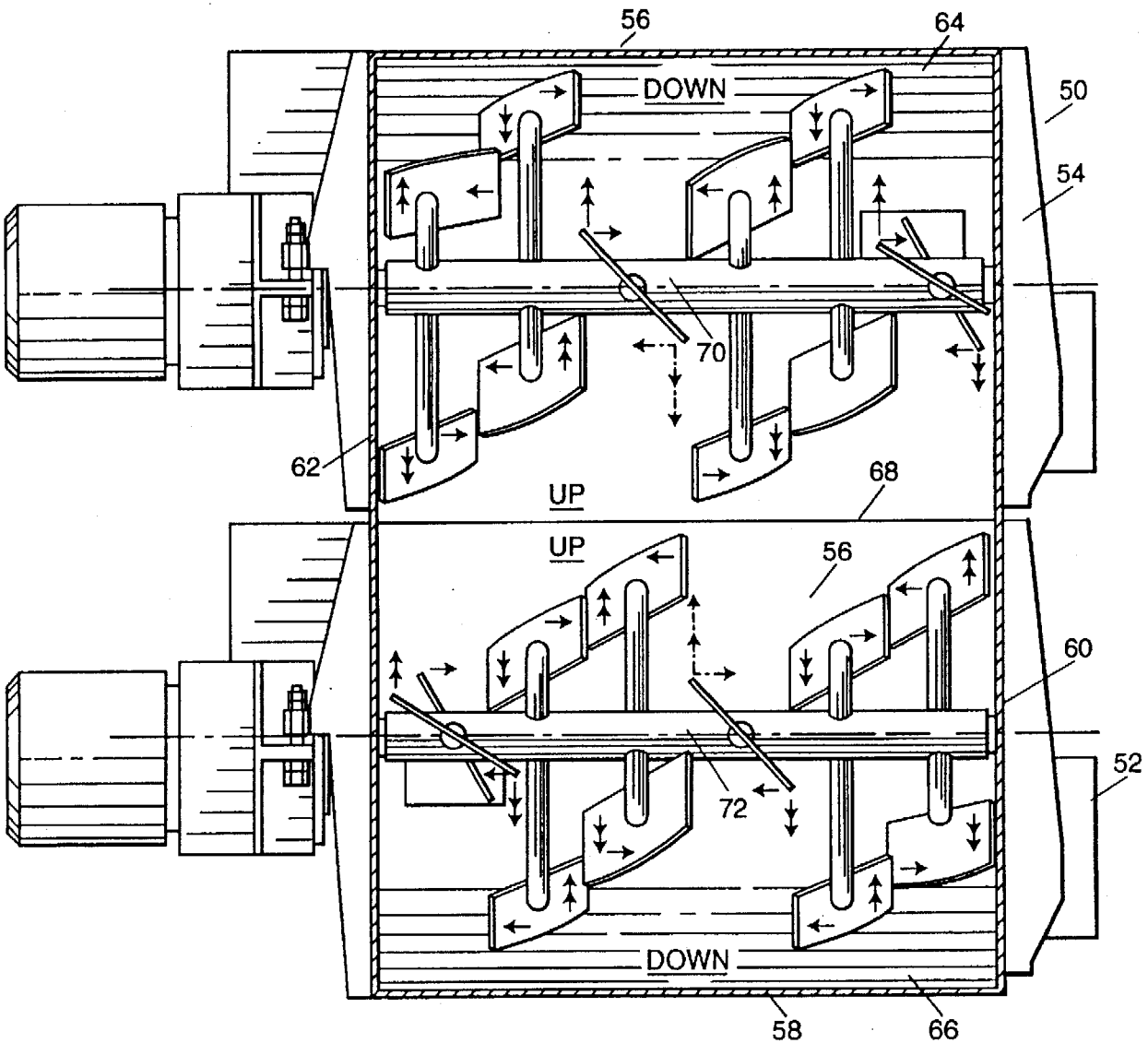
FIG. 4 is a view similar to FIG. 2 and illustrating a second embodiment of the mixer having two shafts and associated mixing elements.

Reference is next made to FIG. 4 which is included to illustrate a mixer which is made essentially of two of the mixers shown in FIG. 2 and indicated generally by the numerals 50, 52. A common housing 54 consists of two side walls 56, 58, end walls 60, 62 and two cylindrically curved bottom walls 64, 66 which blend tangentially into the respective side walls 56, 58 and which meet at a joint 68 lying essentially in the same plane as axes of parallel shafts 70, 72.

The system is modular because each of the mixers conducts its own mixing although there may be some transfer of particulates between the two mixers due to agitation in a common housing. In any event, the relationships are such that zones continue to be built up around each of two mixing elements 54, 56 to provide efficient mixing. The modular approach to provide two machines will of course increase the volume of material that can be mixed at any time. However there are also advantages which result from putting two modular mixers according to the invention in side-by-side relationship. Firstly, the mixing action tends to eliminate shear in the mixture. Also, the zone created between the individual mixers is ideal for adding liquid because the liquid can be sprayed directly on the mix rather than on the rotors.

A further advantage results from the arrangement of paddles. The number of paddles used in the arrangement permits the use of more paddles in a given volume of mix which enhances rapid and efficient mixing.

It will now be evident that the modular construction gives advantageous results both when one module is used and when two modules are used in conjunction with one another.

The invention has been described with reference to preferred embodiments and variations in these designs made in accordance with the inventive concept are within the scope of the invention as described and claimed.

I claim:

1. A single shaft mixer for mixing particulates, the mixer having:

a housing including parallel side walls and end walls arranged orthogonally with respect to the side walls, and a cylindrical curved bottom wall meeting the side walls tangentially and extending between the end walls, the bottom wall being curved about a longitudinal axis passing through the end walls;

a mixing element including a shaft mounted for rotation about said axis and extending between the end walls, and a plurality of inner and outer paddles coupled to the shaft for rotation with the shaft one of the outer paddles nearest the end wall towards which the outer paddles drive the particulates and the one of the inner paddles nearest the other end wall being angled relative to said axis at an angle of about 30 degrees, and the majority of outer paddles and inner paddles being angled relative to said axis at an angle of about 45 degrees; and the mixer defining a series of mixing zones spaced axially along said shaft, each of the mixing zones including at least one of said outer paddles angled relative to said axis to drive particulates in a first axial direction, and at least one of said inner paddles angled relative to said axis to drive particulates in the opposite axial direction, whereby at least some of the particulates in a said zone move in said axial direction under the influence of said outer paddle and in the opposite axial direction under the influence of said inner paddle, and the zones combine to effect mixing of the particulates.

2. A mixer as claimed in claim 1 in which the inner paddles are larger than the outer paddles to compensate for the lower peripheral velocity of the inner paddles relative to the outer paddles.

3. A single shaft mixer for mixing particulates, the mixer having:

a housing including parallel side walls and end walls arranged orthogonally with respect to the side walls, and a cylindrical curved bottom wall meeting the side walls and ends walls and curved about a longitudinal axis passing through the end walls;

a mixing element including a shaft mounted for rotation about said axis and extending between the end walls, and a plurality of inner and outer paddles coupled to the shaft for rotation with the shaft one of the outer paddles nearest the end wall towards which the outer paddles drive the particulates and the one of the inner paddles nearest the other end wall being angled relative to said axis at an angle of about 30 degrees; and the majority of outer paddles and inner paddles being angled relative to said axis at an angle of about 45 degrees;

the outer paddles being attached to the shaft and positioned for movement with the shaft about said axis in dose proximity to said bottom wall, the outer paddles being spaced angularly about the shaft and spaced longitudinally of the shaft, the outer paddles also being angled relative to said axial direction to bias the particulates in a first axial direction; and the inner paddles being spaced radially inwards relative to the outer paddles, each of the inner paddles being spaced angularly about said shaft such that each of the inner paddles is between a pair of said outer paddles, the inner paddles being angled relative to said axial direction to bias the particulates in an axial direction opposite said first axial direction; whereby at least some of the particulates moved by an outer paddle in said first axial direction come under the influence of an adjacent inner paddle to move the particulates in the opposite axial direction thereby creating mixing zones along the length of the mixing element.

4. A mixer as claimed in claim 3 in which the inner paddles are larger than the outer paddles to compensate for the lower peripheral velocity of the inner paddles relative to the outer paddles.

* * * * *